United States Patent [19]

Potter

[11] Patent Number: 4,552,059

[45] Date of Patent: Nov. 12, 1985

[54] FLOW MEASUREMENT FOR EXHAUST-TYPE CANOPY AND VENTILATING HOOD

[75] Inventor: Gary J. Potter, Marthasville, Mo.

[73] Assignee: Cambridge Engineering, Inc., St. Louis, Mo.

[21] Appl. No.: 651,795

[22] Filed: Sep. 18, 1984

[51] Int. Cl.[4] ..... F24C 15/20

[52] U.S. Cl. ..... 98/115.1; 73/196; 73/861.01; 126/299 D

[58] Field of Search ..... 98/1.5, 115 R; 126/299 D; 73/861.01, 196

[56] References Cited

U.S. PATENT DOCUMENTS

| | | | |
|---|---|---|---|
| 3,285,154 | 11/1966 | De Rosa | 126/299 D |
| 3,387,434 | 6/1968 | Stalker | 126/299 D |
| 3,513,766 | 5/1970 | Ahlrich | 126/299 D |
| 3,530,784 | 9/1970 | Courchesne | 126/299 D |
| 3,800,689 | 4/1974 | Brown | 126/299 D |
| 4,085,736 | 4/1978 | Kuechler | 126/299 D |
| 4,089,327 | 5/1978 | Welsh | 126/299 D |
| 4,117,833 | 10/1978 | Mueller | 126/299 D |
| 4,133,300 | 1/1979 | Burton, Jr. et al. | 126/299 D |
| 4,134,394 | 1/1979 | Otenbaker | 126/299 D |
| 4,166,448 | 9/1979 | Miller et al. | 126/299 D |
| 4,177,716 | 12/1979 | Bowe et al. | 126/299 E |
| 4,261,256 | 4/1981 | Jeret | 98/1.5 |
| 4,286,572 | 9/1981 | Searcy et al. | 126/299 D |
| 4,346,692 | 8/1982 | McCauley | 126/299 D |
| 4,372,195 | 2/1983 | Dorius | 126/299 D |
| 4,373,509 | 2/1983 | Nettzel et al. | 126/299 D |

*Primary Examiner*—Ronald C. Capossela
*Attorney, Agent, or Firm*—Paul M. Denk

[57] ABSTRACT

In a ventilating hood of the type incorporating a supply chamber, an exhaust outlet, one or both of which incorporate air blower or moving means, such as fans, pressure taps are incorporated at strategic locations about the supply and exhaust chambers, generally at the location of their separating partitions, as where the air is diffused as passing through the hood, so that pressure drops can be readily determined, and airflows at these locations may be properly set as determined from previously prepared graphs.

5 Claims, 5 Drawing Figures

FLOW MEASUREMENT FOR EXHAUST-TYPE CANOPY AND VENTILATING HOOD

BACKGROUND OF THE INVENTION

This invention relates generally to the accurate and convenient measurement of supply and exhaust airflows through a ventilating apparatus, generally of the type used in conjunction with a restaurant cooker, or the like, so that adjustment can be made in the supply air entering into the hood, or to the exhaust air being exhausted, to provide for that more precise quantities of air circulation therethrough and to minimize the energy requirements for the facility in which this invention is installed.

There are numerous types of ventilating hoods that are primarily used in conjunction with restaurant operations, or other types of facilities in which fumes may be generated, and are required for removal, and usually if these ventilating hoods are not properly balanced in their operations, they either will introduce too much of the outside air into the building, or exhaust an inordinate amount from the structure which may be more than is than required for attaining the convenient and proper circulation and ventilation of the building in which the apparatus is installed. This is not to say that the variety of ventilating hoods as developed, patented, and upon the market, do not operate satsifactorily, since most of them do. On the other hand, the essence of this particular invention is to provide a means for finely tuning the operations of such hoods, so that the more precise amount of supply air will be introduced into the hood, and into the facility in which it is installed, and likewise, a more exact amount of exhaust air will be drawn therefrom, as a result of the initial and precise calibration for these operational characteristics for such a hood, and the periodic measuring of these airflow capacities to assure that the hood has not become misaligned in its functioning.

As an example, the U.S. Pat. No. 4,286,572, upon a ventilating hood, and owned by the assignee of the invention of this current application, shows a style of ventilating hood that incorporates both a supply inlet, an exhaust outlet, and the incorporation of both a supply fan and exhaust fan for attaining the proper movements of airflow through the hood, and primarily for achieving the elimination of fumes from the kitchen or room in which the ventilating hood of this invention is installed. And, as can be readly understood, and as is so thoroughly described in the specification for that earlier patent, it is highly desirable to maintain a proper balance between the amount of incoming air introduced into the facility, through the supply inlet for the hood, and likewise, to achieve that proper balance for exhaust, so that the fumes from the cooking surface will be adequately absorbed into the flow of air through the hood, and out of its exhaust, drawing only a small amount of the ambient and heated or cooled air from the kitchen or room in which the hood is installed, out through the said exhaust outlet. For example, if the exhaust fan or blower is set at too high of a capacity, and which generates an excess of exhausting air from the hood, and the room in which it is installed, then during the summer months, too much of the air conditioned air within the kitchen will be drawn through the exhaust, or during the winter months, too much of the heated air within the kitchen will be drawn through the exhaust, both leading to a needless waste of conditioned air, and the energy consumed in generating it. In addition, if the supply intake is set too low, then, a similar waste of conditioned air takes place. Thus, it can be readily determined that these ventilating hoods must be properly set to precise operations, so that they will operate highly satisfactory for drawing off those fumes from the cooking surface, or from any other apparatus that is used in conjunction with this hood, but at the same time, not operate too excessively or deficiently that the other energy requirement for the facility in which it is installed are unduly taxed leading to needless waste of energy and the incurrence of excessive cost therefor.

A variety of prior patents showing various styles of hoods have been uncovered in a search for prior art relating to this style of invention. For example, U.S. Pat. No. 3,285,154, to De Rosa, shows what is identified as a positive direct relief means for exhaust systems, and which includes various damper means within either the supply inlet or exhaust outlet, and which can be regulated for gauging the amount of air passing through the hood. But, it does not appear that any type of calibration means is associated with this hood and which could provide for immediate testing and gauging for resetting of such instrumentalities so as to assure that a proper functioning and operation is sustained for the shown hood. The U.S. Pat. No. 3,387,434, to Stalker shows a pair of motor operated blowers for effecting supply intake and exhaust for a ventilating hood, but it does not indicate that any precise gauging or calibration is provided for setting or resetting of the air flows passing through the shown hood. The U.S. Pat. No. 3,513,766, to Ahlrich shows a dual air flow device, but it does not show that any precise efficiency for regulation of the airflows is provided within this style of ventilating hood. The U.S. Pat. No. 4,085,735, to Kaufman, shows an air ventilation and washing system, wherein apparently temperature sensing means are provided, but generally for affording fire detection and extinguishing in the event that a grease flash fire, or the like, should occur. The U.S. Pat. No. 4,089,327, to Welsh shows a kitchen exhaust system, where particular quantities of airflow are maintained, but not done so through a pressure regulating mechanism. The U.S. Pat. No. 4,117,833, to Mueller does show an exhaust hood, with adjustable air injection nozzling system, but it is not of any regulated quantity. Although, it is to be noted that the nozzle does incorporate restriction baffles in order to throttle the airflow through the nozzle spout. The U.S. Pat. No. 4,133,300, to Burton, Jr., shows a ventilating range hood, with means for directing airflow within the hood, but does not explain how any pressure may be detected for providing for fine regulation in the flow of air through the shown hood. The U.S. Pat. No. 4,166,448, to Miller, is also upon a ventilation system. And, energy efficiency is apparently maintained through this hood, but not by any controlling of its airflow. The U.S. Pat. No. 4,134,394, to Otenbaker, shows an air ventilation system wherein the temperature of the air is controlled between summer and winter times, so as to provide a desirable working temperature within the kitchen in which the system is installed. The U.S. Pat. No. 4,177,716, to Bowe, does touch upon the concept of providing automatic energy savings within an exhaust system. It discloses an exhaust system control apparatus operating to achieve automatic closure to its damper, in this particular system, or an exhaust duct leading from a spray booth. And, the damper motor is energized to open its said damper when the spray booth is in operation, and likewise, is automatically reversed for controlling the damper into closure, at the termination of a spraying operation. Thus, energy saving is attained, simply by opening and closing of a damper, but not providing for a fine regulation in the operations of the exhaust system through pressure detection. The U.S. Pat. No. 4,346,692, to McCauley, discloses a make-up air device for range hood. In this particular device, once again, control of the air is obtained through adjustable louvers, but it does not appear that there is any precise or fine regulation of the intake air, or its exhaust, by means of pressure regulation or detection. The U.S. Pat. No. 4,373,509, to Neitzel shows a high efficiency ventilation system. As can be seen, it pertains to the regulation of the amounts of fresh air and temperature air handled by the damper, without significantly altering the total amount of supply make-up air passing through the hood. And, the system does recognize that adjustment can be made to the operations of the device so as to use more or less of the temperate air depending upon the conditions around the cooking instrument. And, while the particular ventilation system, and its hood, describes the use of a variety of registers, dampers, and the like, for regulating airflow, there is nothing in this disclosure, upon a review, that explains just how precisely such air flow can be controlled through the use of any pressure detecting means, such as envisioned for the particular invention of this application.

It must also be commented, with respect to the current invention, and the background information relating to it, that pressure regulators, manometers, and the like, have been available for many, many years. But, applicant has not found where such devices have been incorporated into the structure of a ventilating hood, or which have been used in conjunction with such a hood, in order to provide for a very fine calculation and calibration in the operations of ventilating hood, for controlling precisely the amount of intake air supplied to and through the hood, or the amount of exhaust exiting therefrom. This is the essence of this current invention.

It is therefore, the principal object of this invention to provide a procedure for determining both supply and exhaust airflows through a ventilating hood, in order to provide for a very quick and prompt adjustment in their settings, and assure that the ventilating hood is operating at peak efficiency.

Another object of this invention is to provide a ventilating hood that incorporates a means for detecting, through pressure differential, a precise quantity of airflow passing through the hood, and thereby obviate the situation that currently prevails wherein most ventilating hoods currently in use are incapable of attaining air balance measurements, or to control precisely the airflows therethrough.

Another object of this invention is to provide means for achieving accuracy and consistency in the operations of the supply and exhaust fans for a ventilating hood, and thereby achieve energy savings in the sustained operations of such a hood.

Another object of this invention is to provide a precalibration, or a calibration at the factory, of a ventilating hood just after its manufacture, so that the hood can be installed for more accurate operations at a particular site, and can be reset periodically through the application of this current invention to assure that the hood sustains its accurate functioning.

Another object of the current invention is to provide means affiliated with particular locations of a ventilating hood so that airflows can be immediately determined, to assure the maximum and efficient operation of a ventilating hood in its particular setting and installation.

These and other objects will become more apparent to those skilled in the art upon reviewing the summary of this invention, and upon undertaking a study of the description of the preferred embodiment, in view of the drawings.

SUMMARY OF THE INVENTION

Until now, the major problem in calculating the operating cost effect of a kitchen ventilation system has been determining the amount of conditioned air that the canopy removes from the kitchen during its functioning. To perform its intended function of capturing cooking fumes and odors, a kitchen canopy or hood must remove some conditioned air from the room in which it is installed. This causes additional outside air to be drawn into the restaurant, or other building, air which the heating and cooling system must additionally heat and cool, increasing the already high energy bills experienced by all operators.

If, because of improper balance, the canopy removes more conditioned air than is necessary, the owner will be paying higher utility bills and probably will not know it for a variety of reasons. First, the canopy will appear to be operating properly. It will appear to be capturing and removing the cooking smoke, fumes, and odors, so therefore, will seem to be operating properly, as aforesaid. Secondly, unless the owner is inclined to meticulously and tediously analyze the operations of such a device, he will not perform the in depth tracking of the energy usage versus the varying outdoor conditions in cooking appliance usage in order to identify excess energy consumption. Thirdly, the owner probably will not find it practical to spend hundreds of dollars and time to have a professional air balancer regularly determine the actual supply and exhaust airflows for his operating hood.

This invention relates to the modification of a ventilating hood, and of the type utilized for the removal of such fumes and vapors from a kitchen, industrial process, chemical handling and mixing area, in addition to the aforesaid food preparation areas, or from other like processing apparatuses, and more particularly for the accurate measurement of the airflow supplied to an exhausted from the ventilating hood.

The invention employs the ventilating hoods as a calibrated air measuring device. It relies upon the design configuration of the ventilating hood, even of the standard type, or of the components of the ventilating hood through their operations, to provide a pressure measurement which relates to the airflow through segments of the hood. The relationship of the pressure measurements to the airflow defines a system curve fo the supply and/or exhaust airflow characteristics for the standard hood.

In one form of this invention, a single pressure sensing device is utilized to detect the pressure present at that portion of the ventilating hood structure when compared to atmospheric pressure whenever the supply and/or exhaust fans are operating. In another form, two pressure sensing devices are utilized to detect the pressure present on each side of a partition or structure contained with the ventilating hood to determine the pressure differential across or through the partition or structure when the supply and/or exhaust fans are operating. As part of the manufacturing process, the pressure sensing devices are installed, by the provision of tap points or calibrated nozzles at strategic locations, as previously defined, such as at or near the partitions forming either the supply chamber, or the exhaust chamber, for the hood, or at both locations, so that a air line can be promptly attached thereto, from a manometer, and provide for a very quick and promp reading of pressure drops at these various locations. Then a graph containing curves provides means for a quick reading and determination of the quantity of air being supplied to the hood, during its operation, as a result of the pressure drop reading taken therefrom, and in addition, a similar type chart previously prepared, and which relates directly to the operations of the style of hood of this invention, and which has been precalibrated at the factory for proper operation, can likewise provide an immediate readout as a result of the indicated pressure drop as to the volume of exhaust airflow through the hood, and out of the same, during its functioning.

As part of the manufacturing process for the ventilating hood of this invention, and which incorporates the flow measuring devices of this invention, the pressure sensing devices are installed and then ventilating hood is tested to determine the pressure readings at various airflow volumes. By pre-testing the ventilating hood, just after its manufacture, and prior to its installation, an accurate measurement of the range of air volume is obtainable. During the pre-testing, supply air and exhaust air are connected to the ventilation hood to simulate the installed conditions. Standard air measurement procedures, that is, pitot tube traverse, nozzles, orifices, multiple nozzles, arranged in the chambers as set up, are employed to measure the air volume passing through the respective sections of the ventilating hood. In this manner, all of the pressure losses experienced in the routine operations of the hood, after installation, are duplicated originally through this simulated testing. These pressure losses, which include friction losses, normally associated with resistance to flow, as well as, dynamic losses associated with sudden changes in direction or changes in the magnitude of the velocity of air flowing, can be predetermined. Once the air volumes are known, the plotting of the pressure measurements yields a characteristic curve that is independent of the configuration of the duct work that is connected to it in its subsequent installation. As an example, graph curves of this type, which are precalibrated and predetermined, are shown in FIGS. 4 and 5 of the drawings for this application. For a standard hood, as by way of example, the various pressure drops that may be read at the supply intake portion of the hood can be readily gauged to furnish a read-out of the volume of airflow passing through the supply inlet during any moment of operation, as can be seen, in cubic feet per minute of airflow. Likewise, as can be seen in FIG. 5, a early preparation of a chart for the manufactured hood can likewise provide a direct measurement between any pressure drop read at the exhaust chamber, near the exhaust outlet, and which can be gauged to provide a reading in cubic feet per minute of airflow through the hood's exhaust means. Once the air volume ranges are known for a particular hood, the plotting of the pressure measurement yields for these characteristic curves, as can be made.

Ventilating hoods equipped with the pressure sensing devices of this invention, in conjunction with the calibrated characteristic curves are easily balanced, after installation, by connecting a manometer to the pressure sensing devices and then adjusting the fan speeds, if required, to obtain those desired airflows that provide for a peak and efficient operation of the hood. And, if the peak operations can be attained, then as explained in the prior U.S. Pat. No. 4,286,572, a more efficient operation for the hood can be sustained, leading to reduced energy requirements for maintaining the functioning of such a hood after its installation, and for prolonged periods of time during its routine usage. Not only does the method of functioning of this particular invention provide for more accuracy, but it provides for a precise setting for airflows through a ventilating hood, that assures proper operations, at greater accuracy, and eliminates the miss or hit or experimental settings that are currently done with all existing ventilating hoods. In addition, the time required for final adjustment is only a fraction of that required for current balancing techniques, and the skill level required of the person performing this balancing procedure is much less demanding.

The invention, as can be seen in the drawings, can be incorporated into any standard ventilating hood, and pressure taps, to which the manometer or pressure reading gauges, or their air hoses connect, can be arranged at strategic and convenient locations about the hood, so as to provide accurate readings of pressure drops, at these exacting locations, and which can then be read upon charts, of the type as previously explained, for indicating from their curves the volume of airflows through the hood. Thus, airflow volumes can then be accurately set, as predetermined for the proper operations of such a hood, in its given setting, so that efficiency is then attained.

DESCRIPTION OF THE PREFERRED EMBODIMENT

Figure 1:
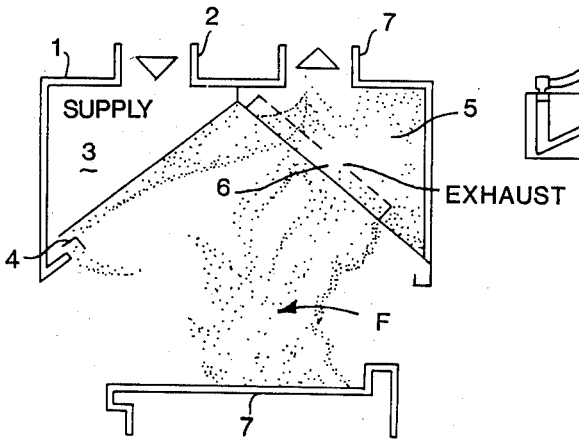
FIG. 1 discloses a schematic view of a ventilating hood disclosing its supply inlet and exhaust outlet, and the fumes arising from a cooking apparatus.

In referring to the drawings, and in particular FIG. 1, as previously explained, therein is disclosed a schematic view for the ventilating hood 1 of the type in which this invention is incorporated. For example, such a ventilating hood customarily includes an inlet 2 that supplies air to supply chamber 3 with the air under pressure then exiting from an outlet or diffuser 4 for direction rearwardly towards an exhaust chamber 5 after passing through its filter 6 for discharge through the exhaust outlet 7. A cooking surface, such as a stove, grill, or the like, as at 7, may ordinarily be used in conjunction with a ventilating hood of this type, and the fumes, as at F, that arise from the surface are desired to be entrained in the flow of ventilating air through the hood and exhausted. Obviously, as previously explained, other instrumentalities may be serviced by the concept of this invention, and the ventilating hood in which it is installed, such other as industrial processing devices, chemical handling and mixing areas, and the like.

Figure 2:
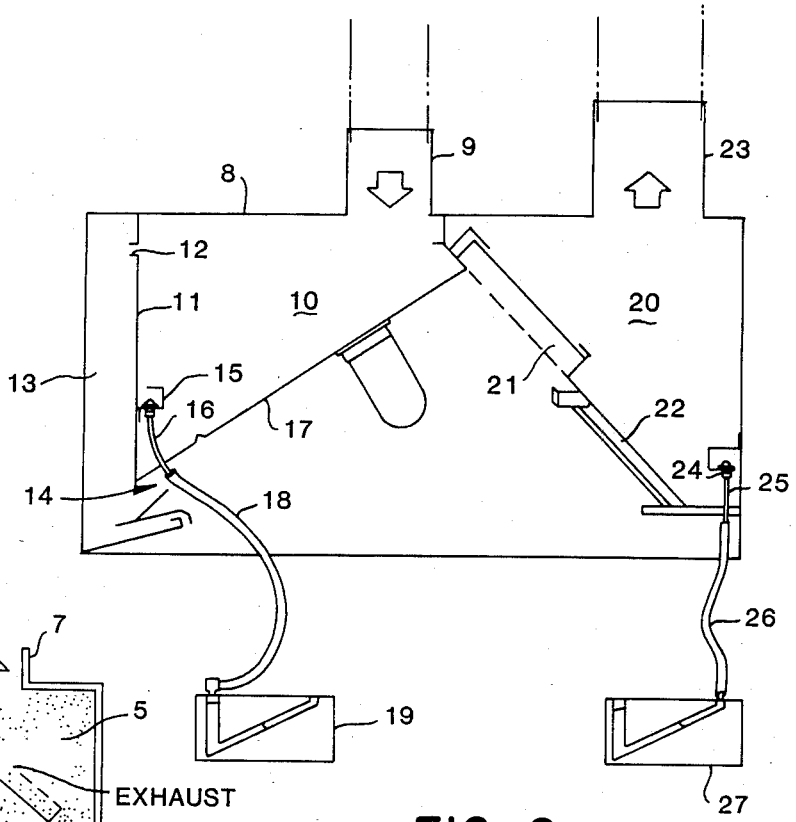
FIG. 2 provides a side schematic view of a ventilating hood having a pair of manometers connected at strategic locations in both the supply and exhaust chambers of the apparatus.

In referring to FIG. 2, a ventilating hood of this type is once again rather accurately shown, and it is not too unlikely that which is set forth in the prior described U.S. Pat. No. 4,286,572. In this instance, the ventilating hood incorporated the housing structure 8 with an intake duct 9, which may have a blower (not shown) therein, and which blower is capable of being adjusted, as through a variable speed motor, adjustable motor pulley, or perhaps through its control through the use of damper means. The supply chamber 10 is partitioned, at its front end, as at 11, having an outlet or diffuser 12 therethrough, and through which the inlet air under pressure is supplied down the flow path 13 for discharge proximate the opening 14. In this particular instance, a pressure tap or sensor 15 is rigidly mounted to the interior of the partition 11, and includes a conduit 16 that extends downwardly through the diverter 17, and readily exposes its downward end for connection with an air line 18 that secures with the manometer 19. In this particular instance, the manometer will detect and determine a pressure drop at the vicinity of the supply chamber 10, with respect to atmospheric pressure. This will be due to the flow of air throught the supply chamber as a result of the operations of its blower. By way of example, there are a variety of manometers available for detecting and gauging pressure variations, and once such manometer as used herein is that manufactured by Dwyer Instruments, Inc., located at Michigan City, Ind. It is marketed under the name Durablock, Model No. 100.5.

As can further be seen in FIG. 2, the exhaust chamber 20 is disposed at the backside of the housing 8, includes a filter 21 provided along the exhaust partition 22, and is primarily furnished for filtering grease or other deleterious particles from the flowing air as it is discharged from the exhaust outlet 23. The exhaust outlet may also include a blower, fan, or the like (not shown) for forcing the discharge in exhausting of air from the ventilating hood. Obviously, any such blower may be variable in capacity, such as operated through a variable speed motor, or the like, and regulated through same controller, or perhaps the air flows are controlled through the adjustment of the rpm ratio between the motor pulley and the blower pulley. In any event, it is to be noted that the supply inlet, or the exhaust outlet, can be regulated, so that particular volumes of movement of air therethrough can be achieved. In addition, connecting within the exhaust chamber 20 is another pressure tap, as at 24, having an air line 25 extending downwardly therefrom, and to which an air hose 26 of a manometer 27 can be conveniently and easily connected, as desired.

Figure 4:
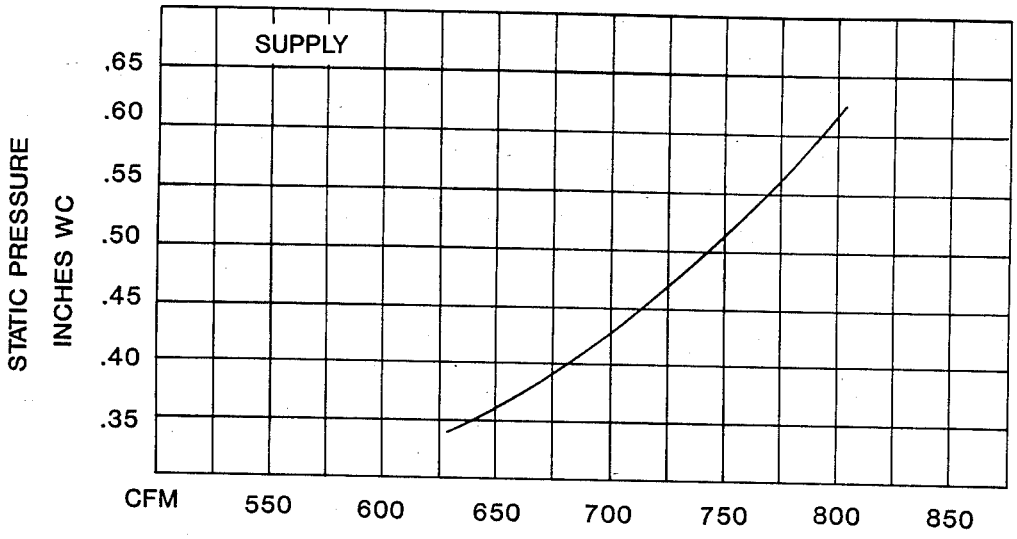
FIG. 4, as previously explained, is a chart disclosing a curve, comparing the static pressure drop versus air volume flow for the ventilating hood.
Figure 5:
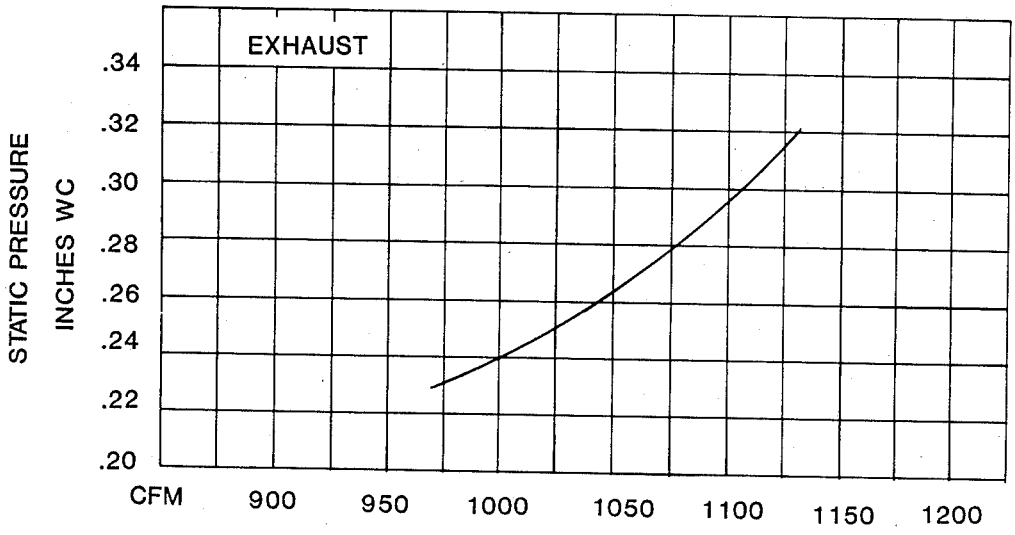
FIG. 5 provides a graph disclosing a curve comparing the static pressure drop versus the air volume flow for the exhaust of the ventilating hood.

In the operations of the type of ventilating hood described in FIG. 2, when a hood of this type is manufactured, charts like those as shown in FIGS. 4 and 5 of the drawings will be prepared disclosing curves that depict pressure drops through the supply chamber, or at the exhaust chamber, in relationship to the various quantities of air that may be circulated therethrough. And, from these particular charts, one can then readily determine for the ventilating hood installed at an installation the amount of airflow attained through either of these chambers, simply by connecting a manometer thereto, and taking a readout of the static pressure. Then, through adjustment, the amount of exhaust airflow required for ventilating a particular installation, such as a restaurant kitchen, in which this hood may be installed, can be determined by gauging its size, volume, and related characteristics. In addition, the size of the heater or cooker involved, and the quantity of fumes rising therefrom, will also be taken into consideration. Then, once the exhaust requirements are set, the proper amount of airflow that is supplied to the hood, by way of the supply inlet 9, can be determined, and compared, in the manner as previously explained in the aforesaid earlier United States patent, so that that proper balance between exhaust and supply can be gauged, their respective airflows readily set, and the most efficient operation for the hood can be established, for that particular installation. And, at any subsequent time, whether it be a month or a year later, by simply connecting a manometer to either of the pressure taps 15 or 24, the airflows can be quickly gauged to determine whether they have varied from their setting, or have maintained stability.

Figure 3:
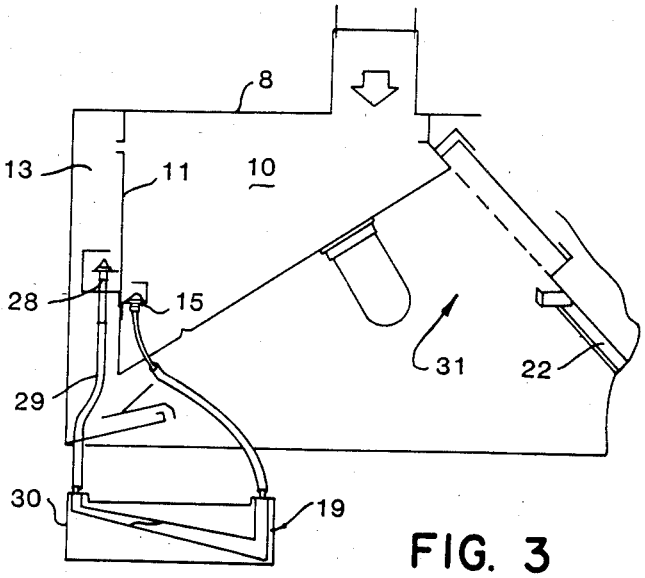
FIG. 3 provides a schematic partial view of a cooking apparatus disclosing how a manometer is connected just interiorly and exteriorly of the supply chamber of an apparatus for detecting a full pressure drop across its supply partition.

In addition to the foregoing, and as can be seen from FIG. 3, it may be desireable to provide means for more precisely gauging the pressure drop across the supply chamber partition 11, as noted, and to achieve this, another pressure tap or sensor 28 will be provided within the flow chamber 13, and have the air line 29 from the manometer 30 connectable therewith for providing for direct pressure readings initially within the supply chamber 10, and just outside of the same within the flow chamber 13, for detecting the pressure drop thereacross, and to attain a very precise reading of the supply volume of airflow passing through the ventilating hood at this location. In addition, although it is not shown, a similar type of arrangement may be set up within the exhaust section 20, so that a differential pressure across a partition or structure within the exhaust chamber 20, can be readily determined, the static pressure drops gauged, and the volume flow of air therethrough can be promptly and accurately determined.

It might be noted that the type of graphs set forth in FIGS. 4 and 5 can be made for each specific hood manufactured, and supplied to the customer with the installed hood, so as to greatly facilitate the ability of the owner to promptly gauge static pressure at various locations about the hood, to determine whether airflow volumes are adequately set. For reasons as previously described, this is of great assistance to the facility owner, it allows one to properly and convenient set the ventilating hood to operate at optimum values, and thereby minimize the amount of energy requirements, or lost energy, that may otherwise be wasted, and is wasted, where no pressure detecting means is provided in the prior art style of ventilating hoods.

Variations or modifications to the subject matter of this invention may occur to those skilled in the art upon reviewing the invention herein. Such variations or modifications, if within the spirit of this invention, are intended to be emcompassed within the scope of any claims to patent protection issuing hereon. The description of the preferred embodiment set forth herein, and the drawings as disclosed, are primarily set forth for illustrative purposes.

Having thus described the invention what is claimed and desired to be secured by Letters Patent is:

1. A ventilating hood for use in conjunction with a processing apparatus such as a cooker or the like and for attaining through a precalibration of the hood to achieve a most effective ventilation of the fumes and air generated in the region of such a cooker, comprising, a housing, a supply chamber and an exhaust chamber operatively associated with the housing, a supply inlet communicating with said supply chamber for conveying fresh air to the housing, an exhaust outlet also communicating with the exhaust chamber for removing the combined air and fumes passing through the housing and from the region of the cooker apparatus, pressure calibration means operatively associated with at least one of said supply chamber and exhaust chamber and when operative providing means for detecting the pressure drops within the housing and for a determination of the setting required for the capacity of supply or exhaust air flows required for a balanced operation of the ventilating hood, said calibration means including a manometer which when connected with one of said supply chamber and exhaust chamber providing for a reading of the pressure drop resulting from air passing through said chambers, said manometer incorporating a pair of pressure sensors for detecting air pressures at two discrete locations, one of said sensors being connected at one location within one of the supply chamber and exhaust chambers, and with the second of said sensors being installed at a remote location from the first mentioned sensor for sensing air pressure to determine pressure variations in the air flow with respect to one of said supply chamber and exhaust chamber.

2. The invention of claim 1 and including an exhaust fan means provided within the exhaust outlet and capable of adjustment in the capacity of its produced airflow in relation to the reading obtained from the calibration means.

3. The invention of claim 1 and including a supply fan means provided within the supply inlet and capable of adjustment in the capacity of its produced air flow in relation to the reading obtained from the calibration means.

4. The invention of claim 1 and including an exhaust fan means provided within the exhaust outlet and capable of adjustment in the capacity of its produced airflow in relation to the reading obtained from the calibration means, and a supply fan means provided within the supply inlet and capable of adjustment in the capacity of its produced airflow operations in relation to the reading obtained from the calibration means.

5. In the method for determining air flow measurements for comparison with precalibrated effective air flow of ventilating air passing through an exhaust type hood as used in conjunction with a food preparation apparatus such as a cooker or the like, including, providing a supply chamber and supply inlet and forcing by way of an air circulating means air under pressure thereto and through the same, providing an adjacent exhaust chamber and outlet and exhausting by way of a blower the supply air therethrough, connecting at least one of a pair of pressure taps of a manometer to at least one of said supply chamber and exhaust chamber and the arranging the other top exteriorly therefor for determining and detecting pressure drops thereat, connecting the said pressure taps at two discrete locations with respect to each other, adjusting the air circulating means in one of said supply inlet and exhaust outlet in response to the pressure tap measurements and known and predetermined air flow measurements for obtaining that flow of pressurized air through the ventilating hood that effectively and efficiently ventilates any fumes arising from the surface of the food preparation apparatus or the like in operation.

* * * * *

UNITED STATES PATENT AND TRADEMARK OFFICE

CERTIFICATE OF CORRECTION

PATENT NO. : 4,552,059

DATED : November 12, 1985

INVENTOR(S) : Gary J. Potter

It is certified that error appears in the above—identified patent and that said Letters Patent is hereby corrected as shown below:

Claim 5, line 28, change "top" to ---tap---.

Signed and Sealed this

*Eleventh* Day of *February 1986*

[SEAL]

*Attest:*

DONALD J. QUIGG

*Attesting Officer*

*Commissioner of Patents and Trademarks*